US007077593B2

(12) United States Patent
Hori

(10) Patent No.: US 7,077,593 B2
(45) Date of Patent: Jul. 18, 2006

(54) WRITING UTENSIL

(75) Inventor: Katsumi Hori, Tsurugashima (JP)

(73) Assignee: Hics corporation, Hiki-Gun (JP)

( * ) Notice: Subject to any disclaimer, the term of this patent is extended or adjusted under 35 U.S.C. 154(b) by 0 days.

(21) Appl. No.: 10/518,009

(22) PCT Filed: Jun. 11, 2003

(86) PCT No.: PCT/JP03/07401

§ 371 (c)(1),
(2), (4) Date: Dec. 14, 2004

(87) PCT Pub. No.: WO04/000575

PCT Pub. Date: Dec. 31, 2003

(65) Prior Publication Data

US 2005/0249542 A1 Nov. 10, 2005

(30) Foreign Application Priority Data

Jun. 24, 2002 (JP) ..... 2002-182610

(51) Int. Cl.
*B43K 5/18* (2006.01)
*B43K 5/00* (2006.01)
*B43K 7/00* (2006.01)

(52) U.S. Cl. ..... 401/242; 401/198; 401/199; 401/209

(58) Field of Classification Search ..... 401/198, 401/199, 223, 224, 209
See application file for complete search history.

(56) References Cited

U.S. PATENT DOCUMENTS 4,770,558 A 9/1988 Frietsch
6,183,155 B1 * 2/2001 Kaufmann ..... 401/199
6,607,325 B1 8/2003 Hori

* cited by examiner

*Primary Examiner*—David J. Walczak
(74) *Attorney, Agent, or Firm*—Manabu Kanesaka

(57) ABSTRACT

A writing instrument has an ink storing chamber 12 formed inside a main body 10 of the writing instrument, a writing element 17 provided on a front end of the main body 10, a reservoir chamber 14 formed between the ink storing chamber 12 and the writing element 17 that communicates with the atmosphere, a partition wall 11 that divides the reservoir chamber 14 and the ink storing chamber 12 with a through hole 11*a* formed in a central portion of the wall, and an elongated ink supply member 20 which supplies ink inside the ink storing chamber 12 to the writing element 17, while being inserted into the through hole 11*a* and maintaining a predetermined gap. The ink supply member 20 is inserted into the through hole 11*a*, while coming into contact with an inner wall of the through hole 11*a* in two or more positions.

9 Claims, 4 Drawing Sheets

WRITING UTENSIL

TECHNICAL FIELD

The present invention relates to a writing instrument of such a type that inside a main body of the instrument is provided an ink storing chamber that stores liquid ink and a reservoir chamber (also referred to as a feeder) that compensates for variations in temperature and pressure inside the ink storing chamber, and that the ink storing chamber and the reservoir chamber are divided by a partition wall.

BACKGROUND ART

As a writing instrument of the type of directly storing liquid ink as described above, as disclosed in JP 2001-315483, there is known a writing instrument in which a circular through hole is formed in the central portion of a partition wall that divides an ink storing chamber and a reservoir chamber, while into the through hole is inserted an ink supply member (relay core that connects a writing element and the ink storing chamber) formed of a rod-like member circular in cross section comprised of porous material. In this structure, a diameter of the through hole is formed to be larger than a diameter of the ink supply member, and a gap capable of holding the ink by capillary force is formed between the ink supply member and an inner wall of the through hole.

The through hole is in a state where an ink membrane (seal) is formed between the outer circumference of the ink supply member impregnated with the ink and the hole by capillary force. The ink membrane of the through hole breaks due to increases or decreases in pressure inside the ink storing chamber, and so-called gas-liquid exchange process is obtained such that the ink flows into the reservoir chamber or air flows into the ink storing chamber. Such gas-liquid exchange process is preferable in structure in terms of compensation for variations in ambient temperature and in pressure inside the ink storing chamber, and the ink membrane is formed in the central axis portion of the ink storing chamber, and therefore, the least prone to influences due to variations in attitude of the writing instrument, whereby seal characteristics are stabilized and it is restricted that the ink flows out of the ink storing chamber to the reservoir chamber accidentally. Further, when the ink is consumed by writing, ink is sucked out of the portion where the ink is held by caterpillar force, and the gas-liquid exchange process is carried out at this portion. Therefore, the ink is supplied to the writing element with high sensitivity, thus providing the writing instrument of structure where light and dark hardly occurs in writing.

The ink supply member is positioned so that a predetermined gap is formed between the outer circumference of the ink supply member and the inner wall of the through hole formed in the partition wall by press-fitting a back end portion of the supply member to a holding member provided on a back end of the main body of the writing instrument to engage therein, and attaching a writing-element portion provided on a front end portion of the ink supply member to the main body of the writing instrument.

In the writing instrument with the aforementioned structure, it is important to control dimensions of the diameter of the ink supply member and of the diameter of the through hole formed in the partition wall. More specifically, as shown in FIG. 1A, a difference between an outer diameter D1 of an ink supply member 1 and a diameter D2 of a through hole 2*a* formed in an partition wall 2 is set at about 0.1 mm (i.e. when D1 is 2 mm, D2 is set at 2.1 mm). In other words, in terms of dimensions of the gap, the gap of substantially 0.05 mm is formed around the outer circumference of the ink supply member.

When the gap is excessively wide (more than or equal to 0.2 mm), the ink flows out irrespective of types of ink. Meanwhile, when the gap is excessively narrow, supply of the ink cannot catch up with writing speed, and light and dark (ink squeeze out) occurs on characters. Further, the expansion coefficient of the ink supply member varies with the material of the ink supply member and the ink (such as oil-based ink and water-based ink) to use. Therefore, when the gap is formed narrowly in advance, the ink becomes stuck and/or light and dark occurs on characters. Accordingly, in preparing the writing instrument with the above-mentioned structure, it is important to control dimensions of the ink supply member and of the through hole formed in the partition wall.

When the ink supply member is actually incorporated into the main body of the writing instrument, depending on conditions of press fitting of the end portion, it sometimes happens that the axis of the ink supply member deviates as shown in FIG. 1B, and the gap changes. In this case, since there are preparation errors to some extent in the diameter of the ink supply member and in the diameter of the through hole formed in the partition wall, the gap G1 generated by the axis deviation may be 0.2 mm or more. When the gap thus becomes 0.2 mm or more, the ink flows out, and there arise possibilities such that writing becomes unable before the ink is completely used and that the ink leaks. Particularly, in the structure where the ink storing chamber is partitioned using a plurality of partition walls, when distortion occurs on the ink supply member, the aforementioned problem tends to arise in either partition wall portion. Accordingly, the precision in incorporating the ink supply member is important in preparing the writing instrument with the above-mentioned structure.

As described above, the structure of well-known technique requires precise dimension control of constituent members and incorporation technique of high precision, and has the problem that fluctuations in quality are apt to occur for each product due to dimension error and/or distortion of the ink supply member caused by incorporation.

In view of the foregoing, it is an object of the present invention to provide a writing instrument which is easy in manufacturing and has a structure such that fluctuations hardly occur in quality, where the writing instrument has the structure in which an ink storing chamber and a reservoir chamber are divided by a partition wall, while an ink supply member that supplies ink is inserted into the partition wall with a predetermined gap kept.

DISCLOSURE OF INVENTION

A writing instrument of the present invention is provided with an ink storing chamber formed inside a main body of the writing instrument, a writing element provided on a front end of the main body of the writing instrument, a reservoir chamber which is formed between the ink storing chamber and the writing element and communicates with the atmosphere, a partition wall that divides the reservoir chamber and the ink storing chamber with a through hole formed in a central portion of the wall, and an elongated ink supply member which supplies ink inside the ink storing chamber to the writing element, while being inserted into the through hole with a predetermined gap kept, and there is provided a feature that the ink supply member is inserted into the through hole, while coming into contact with an inner wall of the through hole in two or more positions.

The writing instrument with the aforementioned structure is provided with a state where an ink membrane (seal) is formed by capillary force between the inner wall of the through hole formed in the partition wall and the outer circumference of the ink supply member impregnated with the ink. The ink membrane of the through hole breaks due to increases or decreases in pressure inside the ink storing chamber, and so-called gas-liquid exchange process is obtained such that the ink flows into the reservoir chamber or air flows into the ink storing chamber. Further, when the ink is consumed by writing, the ink held by capillary force is sucked out and supplied to the writing element. Thus, since the ink supply member is inserted into the inner wall of the through hole while coming into contact with the inner wall in two or more position, it is possible to perform positioning of the ink supply member with respect to the through hole with ease, and to maintain the size of the gap at an optimal state readily.

BEST MODE FOR CARRYING OUT THE INVENTION

Embodiments of the present invention will specifically be described below with reference to accompanying drawings.

Figure 2:
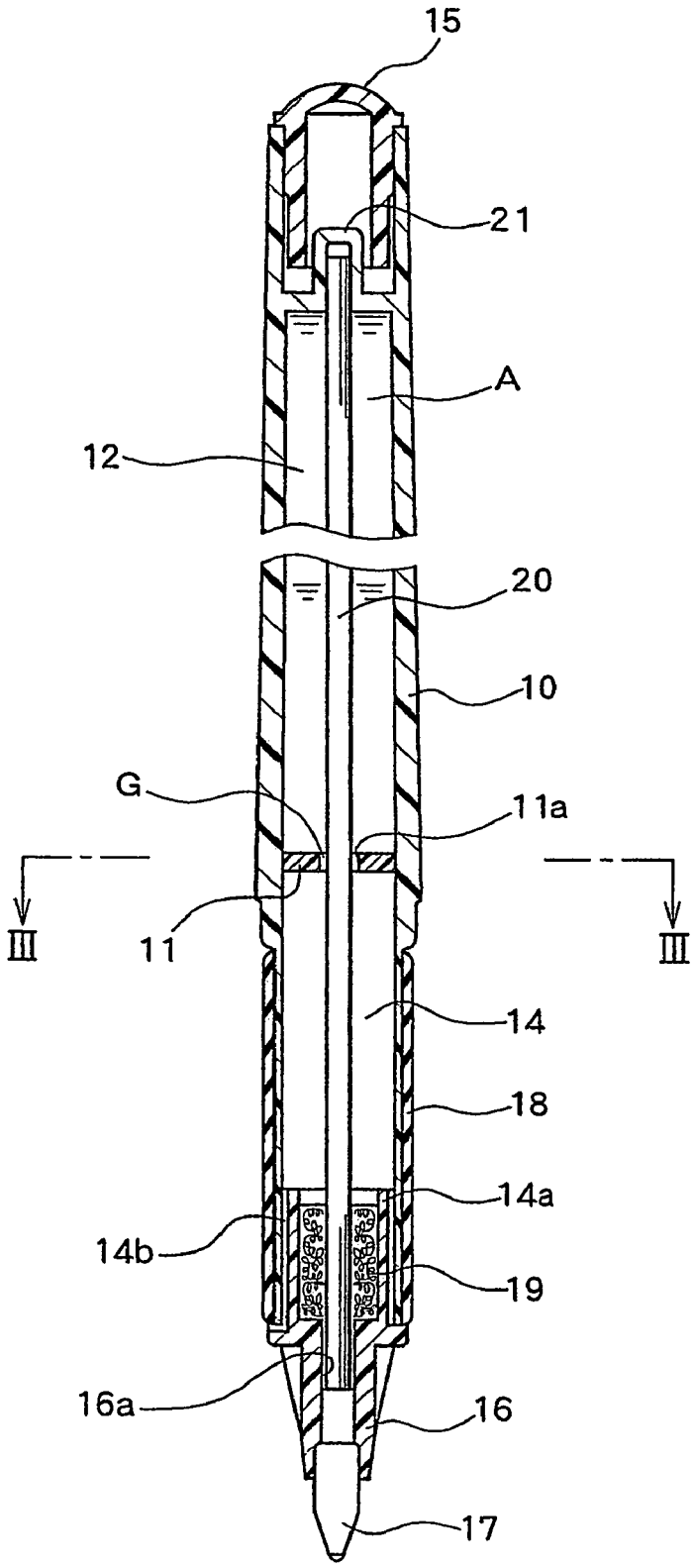
FIG. 2 is a view showing an embodiment of a writing instrument according to the preset invention.

FIG. 2 is a view showing a first embodiment of the present invention. A writing instrument of this embodiment is provided with a barrel i.e. writing instrument main body 10, and inside the main body 10 is provided a partition wall 11 in the direction perpendicular to the axis direction. The tail end side partitioned by the partition wall 11 is formed as a cylindrical ink storing chamber 12 impregnated with ink A, while the front end side is formed as a cylindrical reservoir chamber 14. In addition, the partition wall 11 is formed by press-fitting a circular-plate shaped member to the inside of the main body 10, and in the central portion of the wall 11 is formed a through hole 11*a* into which an ink supply member, described later, is inserted with a predetermined gap.

A tail plug 15 is attached to a tail end portion of the main body 10, and a chip holder 16 is attached to a front end portion of the body 10. A ball chip (writing element) 17 for water-based ink is attached to a front end portion of the chip holder 16. Non-slip rubber boot 18 is provided on the periphery of the front end portion of the main body 10.

An upper end portion of the chip holder 16 is formed in the shape of a cup, while being press-fitted to the inside of the main body 10, and forms an ink receiving portion 14*a* of the reservoir chamber 14. At a bottom portion of the receiving portion 14*a* is provided a porous ink holding member 19 formed of fibrous material or the like to hold impregnated ink. In this case, it is not necessary to provide the ink holding member 19 particularly, and if provided, the structure of the member 19 is not limited to the porous member formed of fibrous material or the like.

A groove 14*b* extending in the axis direction is provided on the outer circumference surface of the receiving portion 14*a* of the chip holder 16, and forms an atmospheric communication passage that communicates with the atmosphere with an inner circumference surface of the main body 10. In this case, since the porous ink holding member 19 is provided inside the reservoir chamber 14, the ink holding member 19 is impregnated with the ink flowing to the reservoir chamber to hold the ink, and thus reliably prevents the ink from leaking outside from the groove 14*b*.

Inside the main body 10 is provided an ink supply member (relay core) 20 extending in the axis direction. The ink supply member 20 is comprised of a porous rod-like member obtained by collecting and compressing a large number of fibers in parallel to the axis direction, and supplies the ink to the writing element side by capillary force.

The ink supply member 20 is provided over the substantially entire length along the central axis line of the main body 10, and a front end portion of the member 20 is held inside a holding hole 16*a* formed in the chip holder 16 with a gap existing to some extent. A tail end portion of the ink supply member 20 is held and engaged in a holding portion 21 formed at the tail end portion of the main body 10, and positioning in the axis direction is made with lower and upper ends.

A middle portion of the ink supply member 20 penetrates the ink storing chamber 12, the through hole 11*a* of the partition wall 11 and reservoir chamber 14. In this case, a predetermined gap G is formed between the inner wall of the through hole 11*a* of the partition wall 11 and the outer circumference of the ink supply member 20 so as to hold the ink by capillary force. The size of the gap G is set as appropriate according to the type of ink to use or the like, and in general, formed to be 0.2 mm at the maximum or less.

Figure 3A:
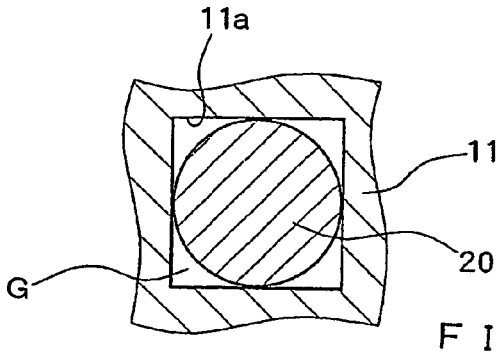
FIGS. 3A to 3E are cross-sectional views taken along line III—III in FIG. 2 showing various structure examples of a partition wall into which the ink supply member is inserted.

FIG. 3A is a view showing a structure of the through hole 11*a* formed in the partition wall 11 and the ink supply member 20 inserted into the hole 11*a*. In this embodiment, the through hole 11*a* is formed in the shape of a square, and the ink supply member 20 inserted into the hole 11*a* is formed to have a circular cross section. Each side of the through hole 11*a* is formed to substantially be equal to the diameter of the ink supply member 20, so that a configuration is obtained where the outer circumference of the member 20 comes into contact with the inner wall of the through hole 11*a* in four positions at 90-degree intervals when the ink supply member 20 is inserted into the through hole.

By thus configuring, in incorporating the ink supply member 20 into the writing-instrument main body, the positioning is made by the contact portions. Therefore, even when distortion occurs on the ink supply member due to press-fitting conditions of the end portion or the like, it is possible to reliably form the gap G along the axis direction in the state as shown in FIG. 3A, and it is made easy to control dimensions of the ink supply member 20 and the through hole 11*a* of the partition wall 11. In other words, even when there occur dimension errors of some extent and/or errors in precision in assembling in the end portion of the ink supply member, it is possible to form the predetermined gap G with ease and reliability, and to maintain the predetermined gap along the axis direction irrespectively of the thickness of the partition wall.

Further, even when the ink supply member 20 expands during use due to conditions of used ink, material or the like, it is possible to maintain a state where the gap is formed reliably around the ink supply member, and it is thereby possible to effectively prevent clogging with the ink during use and occurrences of dark and light characters during writing.

In addition, when the ink supply member 20 has a circular cross section and the through hole 11*a* of the partition wall 11 is shaped in the form of a polygon, as shown in figures, it is preferable that the length of each side of the polygon is the same (in the form of a regular polygon). By thus configuring, the ink supply member 20 comes into contact on its outer circumference with the inner wall of the through hole at regular intervals, whereby the gap G is provided equally along the circumference of the ink supply member 20, and the gas-liquid exchange process is carried out with stability.

Figure 3B:
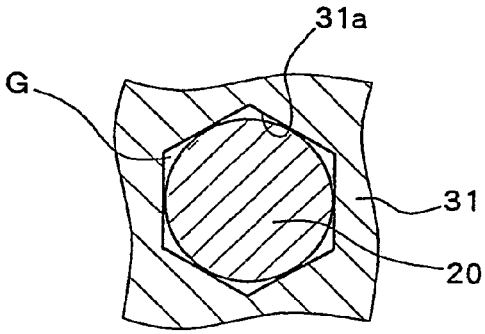
Figure 3C:
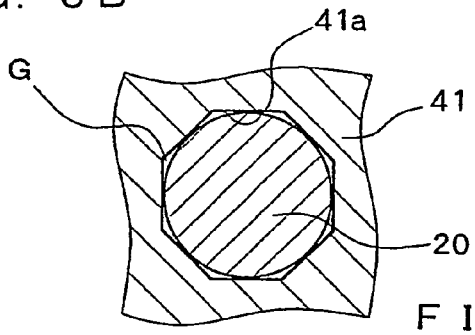

Further, in such a configuration, by forming a regular hexagonal through hole 31*a* or regular octagonal through hole 41*a* in a partition wall 31 or 41 as shown in FIG. 3B or FIG. 3C, respectively, corresponding to the type of used ink and material of the ink supply member 20, it is possible to adjust the size of the gap G with ease without the need of securing the restrict dimension control and assembling precision.

Figure 3E:
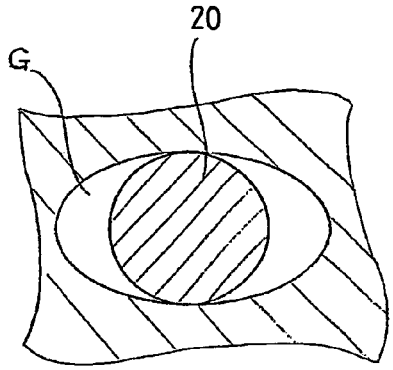
Figure 3D:
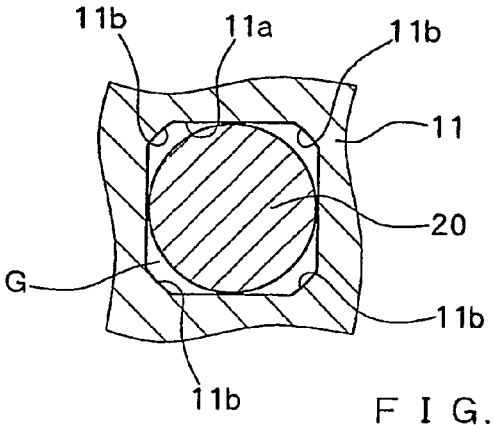

Depending on the shape of a polygon of the through hole, the distance between the corner portion of the polygon and the outer circumference of the ink supply member becomes excessively larger than the distance required for the used ink. In such a case, as shown in FIG. 3D, each corner portion may be provided with a closing portion 11*b* that narrows the distance from the outer circumference of the ink supply member. Such a closing portion may be formed to extend toward the axial core of the ink supply member, for example, by providing the corner portion with a radius. Forming such a closing portion also enables the size of the gap G to be adjusted irrespectively of the number of sides of the polygon.

In addition, with respect to the ink supply member 20 and the through hole formed in the partition wall, as long as the outer circumference portion of the ink supply member is configured to come into contact with the through hole in two or more position, the positioning is made readily and a reliable gap can be formed. Therefore, it is possible to modify the cross-sectional form of the ink supply member and the form of the through hole in various manners. For example, when the ink supply member has a cross section in the form of a circle and the through hole is in the form of an ellipse as shown in FIG. 3E, the positioning can be made by bringing the ink supply member into contact with the wall portion of the through hole in two positions. An inverse case to the aforementioned structure is also preferable where the ink supply member has a cross section in the form of a polygon or ellipse and the through hole is in the form of a circle. Further, it may be possible that the cross section of the ink supply member and the through hole are both in the form of a circle, and that the through hole is provided with ribs to come into contact with the outer circumference of the ink supply member at predetermined intervals.

Figure 4:
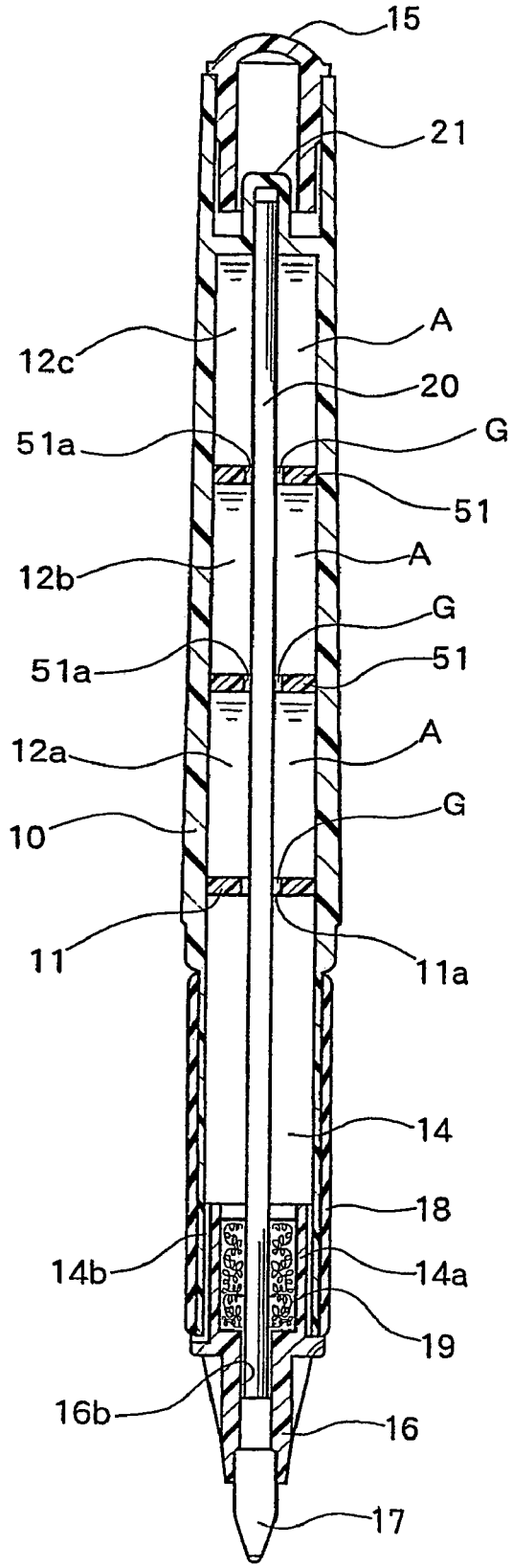
FIG. 4 is a view showing another embodiment of the writing instrument according to the present invention.

FIG. 4 is a view showing another embodiment of the writing instrument.

This embodiment illustrates an example where inside the ink storing chamber as shown in FIG. 2 are provided a plurality of (two) ink storing chamber partition walls 51 in which are formed through holes 51*a* into central portions of which is inserted the ink supply member 20, and the ink storing chamber is thereby divided into a plurality of chambers in the axis direction (divided small ink storing chambers are indicated by 12*a*, 12*b* and 12*c*). In this case, it is only required to provide at least one or more ink storing chamber partition walls 51, and by configuring each of the walls 51 in the same way as in the above-mentioned partition wall 11 (31, 41), the gap G is formed between the outer circumference of the ink supply member 20 and the wall. In addition, in such a configuration where the ink storing chamber partition wall 51 is provided, since positioning of the ink supply member 20 is made by the partition wall 11 (31, 41), the through hole 51*a* formed in the ink storing chamber partition wall 51 may be in the form of a circle as the conventional case.

Figure 1B:
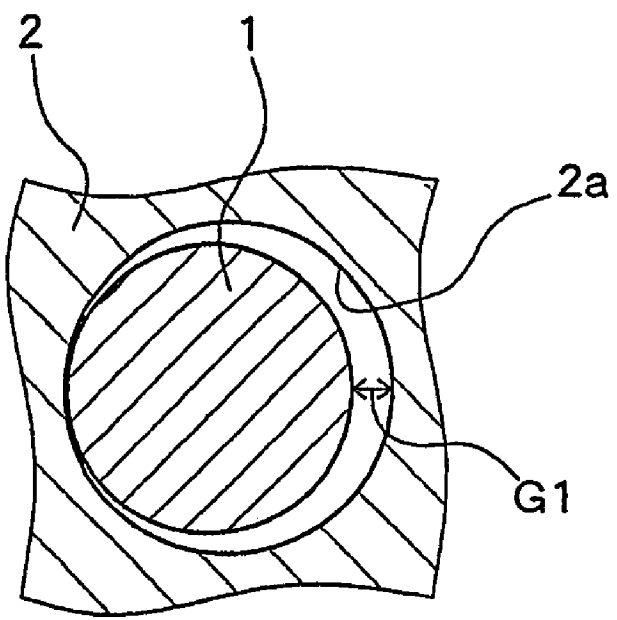
FIG. 1B Prior Art
FIG. 1B is a view showing a state where an axis of the ink supply member deviates.
Figure 1A:
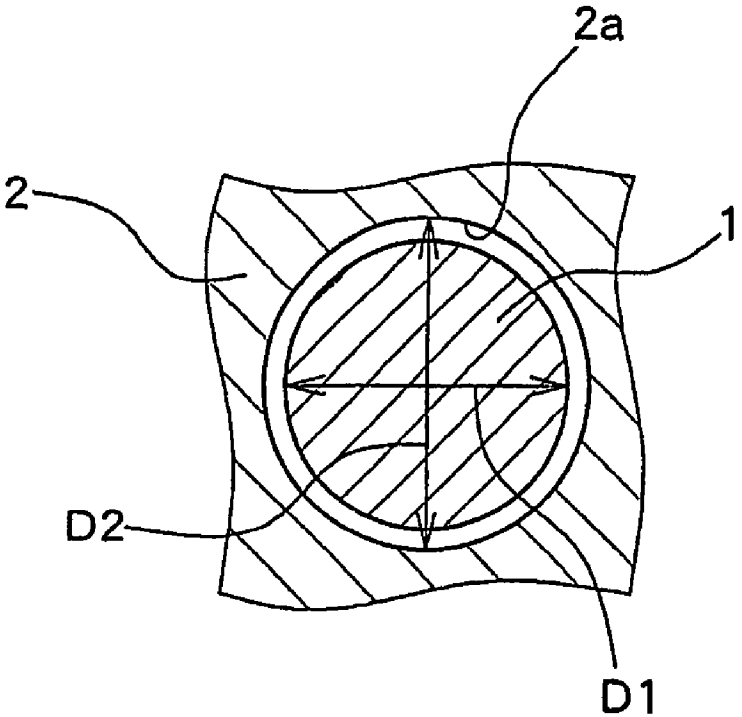
FIG. 1A Prior Art
FIG. 1A is a view showing an ideal state of the relationship in insertion between a through hole formed in a partition wall and an ink supply member in a conventional writing instrument.

According to the aforementioned structure, the ink is consumed sequentially starting from the small chamber 12*a* on the writing element side, air is introduced to the small chamber when the ink in the small chamber is consumed, and the small chamber serves as a reservoir chamber in turn, thus enabling the increased amount of ink storage. Further, in such a structure where a plurality of partition walls are formed, the core tends to deviate as shown in FIG. 1B in the conventional partition wall structure when distortion occurs on the ink supply member. However, by configuring the partition wall as described above, even when such distortion occurs, a suitable gap G is formed along the axis direction in the portion of the through hole of each partition wall.

In other words, even when there occur dimension errors of some extent and/or errors in precision in assembling in the end portion of the ink supply member, it is possible to form the predetermined gap G with ease and reliability, and to obtain the stable gas-liquid exchange process.

Further, when the ink storing chamber partition wall 51 is thus provided, in order to inject the ink with stability, it is preferable to adjust the sensitivity of the gas-liquid exchange (timing at which the ink membrane held in the gap breaks) in the through hole of the partition wall 11 (31 and 41) and the through hole of the ink storing chamber partition wall 51. In other words, in order to inject the ink with stability, it is necessary to adjust the amount of used ink and the amount of ink supply. This is because when the through hole of the partition wall 11 (31, 41) has the same structure as that of the through hole of the ink storing chamber partition wall 51 and the ink storing chamber is emptied that is provided between the partition wall 11 (31, 41) and the ink storing chamber partition wall 51, the sensitivity in gas-liquid exchange in the through hole of the ink storing chamber partition wall 51 becomes worse than the sensitivity in gas-liquid exchange in the through hole of the partition wall 11 (31, 41). When the timing of the gas-liquid exchange thus delays in the ink storing chamber partition wall 51, it takes time for the ink to move to the writing element side, and ink squeeze out occurs on characters. Accordingly, the gap of the through hole 51*a* formed in the ink storing chamber partition wall 51 is preferably formed to be larger than the gap of the through hole formed in the partition wall 11 (31, 41) to provide excellent sensitivity in the gas-liquid exchange. Further, in the configuration where a plurality of ink storing chamber partition walls 51 are provided inside the ink storing chamber, the gap of the through hole formed in each of the ink storing chamber partition walls is preferably formed to be larger in the order in which the wall is closer to the back end side of the main body of the writing instrument.

Embodiments of the present invention are described in the foregoing, and the present invention has features in the partition wall portion where the through hole is provided and in the cross-section form of the ink supply member, and is capable of being carried into practice with various modifications in other structure. For example, while the above-mentioned embodiments use a ball chip as a writing element, a structure may be possible where the end portion of the ink supply member functions as the writing element. Further, it may be possible to vary as appropriate the method of supporting the ink supply member at the back end.

INDUSTRIAL APPLICABILITY

The present invention is applicable to small-size writing instruments such as a refill and writing instrument attached to a notebook, and further, to disposable writing instruments and other general writing instruments.

The invention claimed is:

1. A writing instrument comprising:

an ink storing chamber formed inside a main body of the writing instrument;

a writing element provided on a front end of the main body of the writing instrument;

a reservoir chamber which is formed between the ink storing chamber and the writing element and communicates with the atmosphere;

a partition wall that divides the reservoir chamber and the ink storing chamber with a through hole formed in a central portion of the wall; and an elongated ink supply member which has an outer circumference with a predetermined gap kept between the circumference and an inner wall of the through hole when the member is inserted into the through hole, and supplies ink inside the ink storing chamber to the writing element, wherein the inner wall of the through hole into which the ink supply member is inserted with the predetermined gap kept has two or more contact portions which come into contact the outer circumference of the ink supply member, and wherein the ink supply member has a circular cross section, and the through hole is a polygon or an ellipse with which the outer circumference of the ink supply member comes into contact at predetermined intervals.

2. The writing instrument according to claim 1, wherein the through hole formed in the polygon has sides each of which is equal in size.

3. A writing instrument comprising:

an ink storing chamber formed inside a main body of the writing instrument;

a writing element provided on a front end of the main body of the instrument;

a reservoir chamber which is formed between the ink storing chamber and the writing element and communicates with the atmosphere;

a partition wall that divides the reservoir chamber and the ink storing chamber with a through hole formed in a central portion of the wall; and an elongated ink supply member which has an outer circumference with a predetermined gap kept between the circumference and an inner wall of the through hole when the member is inserted into the through hole, and supplies ink inside the ink storing chamber to the writing element, wherein the inner wall of the through hole into which the ink supply member is inserted with the predetermined gap kept has two or more contact portions which come into contact the outer circumference of the ink supply member, and wherein the through hole is provided in its corner with a closing portion existing near the outer circumference of the ink supply member.

4. A writing instrument comprising:

an ink storing chamber formed inside a main body of the writing instrument;

a writing element provided on a front end of the main body of the writing instrument;

a reservoir chamber which is formed between the ink storing chamber and the writing element and communicates with the atmosphere;

a partition wall that divides the reservoir chamber and the ink storing chamber with a through hole formed in a central portion of the wall; and an elongated ink supply member which has an outer circumference with a predetermined gap kept between the circumference and an inner wall of the through hole when the member is inserted into the through hole, and supplies ink inside the ink storing chamber to the writing element, wherein the inner wall of the through hole into which the ink supply member is inserted with the predetermined gap kept has two or more contact portions which come into contact the outer circumference of the ink supply member, and wherein the ink storing chamber is divided into a plurality of chambers in the axis direction using one or more ink storing chamber partition walls each provided with a through hole into which the ink supply member is inserted with a gap kept.

5. The writing instrument according to claim 4, wherein the gap of the through hole formed in each of the ink storing chamber partition walls is formed to be larger than the gap of the through hole formed in the partition wall that divides the reservoir chamber and the ink storing chamber.

6. The writing instrument according to claim 5, wherein the plurality of ink storing chamber partition walls is provided in the ink storing chamber, and the gap of the through hole formed in each of the ink storing chamber partition walls is formed to be larger as shifted to the back end side of the main body of the writing instrument.

7. The writing instrument according to claim 4, wherein the ink supply member is inserted into the through hole formed in each of the ink storing chamber partition walls, while coming into contact with an inner wall of the through hole in two or more positions.

8. The writing instrument according to claim 1, wherein the reservoir chamber is provided with an ink holding member capable of being impregnated with ink to hold the ink.

9. The writing instrument according to claim 1, wherein the contact portions are formed on the inner wall of the through hole and are ribs coming into contact with the outer circumference of the ink supply member.

* * * * *